US009366455B1

(12) United States Patent
Conemac

(10) Patent No.: US 9,366,455 B1
(45) Date of Patent: Jun. 14, 2016

(54) SYSTEM AND METHOD FOR INDIRECTLY HEATING A LIQUID WITH A LASER BEAM IMMERSED WITHIN THE LIQUID

(71) Applicant: Donald Conemac, Orlando, FL (US)

(72) Inventor: Donald Conemac, Orlando, FL (US)

(73) Assignee: LASER HEATING ADVANCED TECHNOLOGIES, LLC, Orlando, FL (US)

( * ) Notice: Subject to any disclaimer, the term of this patent is extended or adjusted under 35 U.S.C. 154(b) by 0 days.

(21) Appl. No.: 14/799,000

(22) Filed: Jul. 14, 2015

(51) Int. Cl.

| | |
|---|---|
| ***F24H 1/10*** | (2006.01) |
| ***B23K 26/00*** | (2014.01) |
| ***F24H 3/12*** | (2006.01) |
| ***F24H 3/00*** | (2006.01) |
| ***F24H 9/00*** | (2006.01) |
| ***F24H 9/20*** | (2006.01) |

(52) U.S. Cl.
CPC ..... *F24H 3/12* (2013.01); *F24H 3/002* (2013.01); *F24H 9/0021* (2013.01); *F24H 9/2028* (2013.01)

(58) Field of Classification Search
None
See application file for complete search history.

(56) References Cited

U.S. PATENT DOCUMENTS

| | | | | |
|---|---|---|---|---|
| 4,644,169 | A | 2/1987 | Hunt | |
| 4,658,115 | A | 4/1987 | Heath | |
| 4,864,098 | A | 9/1989 | Basanese et al. | |
| 5,685,997 | A | 11/1997 | LoPresti | |
| 6,710,281 | B1 | 3/2004 | Wachnuk | |
| 6,792,017 | B2 | 9/2004 | Halpin | |
| 7,015,422 | B2 | 3/2006 | Timans | |
| 7,027,479 | B2 | 4/2006 | Stewart et al. | |
| 7,153,285 | B2 | 12/2006 | Lauman et al. | |
| 8,047,663 | B2 * | 11/2011 | Pang | G02B 5/003 219/121.6 |
| 8,881,526 | B2 | 11/2014 | Bastian, II et al. | |

FOREIGN PATENT DOCUMENTS

| | | |
|---|---|---|
| CN | 2608906 | 3/2004 |
| CN | 102331081 | 1/2012 |
| DE | 19716040 | 9/1998 |
| EP | 0551546 | 7/1993 |
| GB | 2492363 | 1/2013 |
| JP | 2010246257 | 10/2010 |
| KR | 20120119660 | 10/2012 |
| WO | 2012/156788 | 11/2012 |

* cited by examiner

*Primary Examiner* — Thor Campbell
(74) *Attorney, Agent, or Firm* — Terry M. Sanks, Esq.; Beusse Wolter Sanks & Maire, PLLC

(57) ABSTRACT

A system including a heatable tube, through which a liquid flows, with at least one opening formed through an outer wall of the tube and a laser directing a laser beam through the opening to an inner surface of the heatable tube to heat the cylinder. The system may be utilized within a hot water heater. A method and a hot water heater system are also disclosed wherein the liquid is indirectly heated with a laser.

29 Claims, 4 Drawing Sheets

SYSTEM AND METHOD FOR INDIRECTLY HEATING A LIQUID WITH A LASER BEAM IMMERSED WITHIN THE LIQUID

BACKGROUND

Embodiments relate to heating a liquid and, more particularly, to heating the liquid with a laser passing through the liquid to heat a heating device.

Water heating is a thermodynamic process that uses an energy source to heat water above its initial temperature. Fossil fuels such as, but not limited to, natural gas, liquefied petroleum gas, oil), or solid fuels are commonly used for heating water. These may be consumed directly or may produce electricity that, in turn, heats water. Electricity to heat water may also come from any other electrical source, such as nuclear power or renewable energy. Alternative energy such as solar energy, heat pumps, hot water heat recycling, and geothermal heating can also heat water, often in combination with backup systems powered by fossil fuels or electricity.

Water heaters have traditionally been tank type systems with a cylindrical vessel or container that keeps water continuously hot and ready to use once warmed by using electricity, gas or propane, a heat pump or a hybrid. When electricity is used, typically two heating elements are used to heat the water. Gas heat pumps use a burner to heat the water. A heat pump or hybrid uses energy from the air to heat the water. The heating elements in prior art water heaters, in both the electricity and gas versions, typically heat from the bottom, with the air rising through the tank and exiting from the top, allowing a fair amount of heat to be wasted. Tankless models also heat from the bottom, but the water flows through copper pipes. However, tankless models have been criticized as they do not store water and continually provide hot water to multiple locations in a facility relaying on the water heater to provide warm water.

Energy efficiencies of water heaters in residential use can vary greatly. Electric heaters tend to be slightly more efficient with a high recovery efficiency whereas gas fired heaters have a lower recovery efficiency than electric heaters as any remaining heat is lost with the flue gasses.

As part of the National Appliance Energy Conservation Act (NAECA), new minimum standards for efficiency of residential water heaters went into effect. All new gas storage tank water heaters with capacities smaller than fifty-five (55) US gallons (210 l; 46 imp gal) sold in the United States must now have an energy factor of at least sixty percent (60%) for 50-US-gallon units, higher for smaller units. This is an increase from the pre-2015 minimum standard of fifty-eight percent (58%) energy factor for a fifty (50) gallon gas unit. Electric storage tank water heaters with capacities less than 55 US gallons sold in the United States must have an energy factor of at least ninety-five percent (95%), which is an increase from the pre-2015 minimum standard of ninety percent (90%) for 50-gallon electric units.

The cost associated with operating a water heater varies based on the type of heating system used. For example, a typical electric water heater has two electrical elements which consume approximately forty-five hundred watts (4500 W) of electricity to heat the water. In comparison a hybrid water heater such as, but not limited to, the General Electric® GeoSpring™ water heater, uses approximately six hundred and seventy-two watts (672 W) to heat the water. Thus, a typical electric water heater costs about five hundred and eighty-five dollars a year to operate whereas a hybrid water heater costs about two hundred and twenty dollars a year to operate.

As the standards for efficiency increase, makers and users of water heaters would benefit from a water heater that exceeds these standards while also saving the user more money when using such a water heater than both electric and hybrid water heaters.

SUMMARY

Embodiments relate to a system and a method for heating a liquid with a laser heated rod placed within the liquid. The system comprises a heatable tube, through which a liquid flows, with at least one opening formed through an outer wall of the tube and a laser directing a laser beam through the opening to an inner surface of the heatable tube to heat the cylinder.

In another embodiment, a hot water heater system is disclosed. The hot water heater comprises at least one cylinder with an outer wall with openings extending through the outer wall to an inner cavity, wherein water passes through the inner cavity. The hot water heater also comprises a plurality of lasers with each respective laser positioned proximate a respective opening to illuminate a laser beam into the cavity and terminating against an inner wall of the cylinder to heat the cylinder. The hot water heater also comprises a water tank to hold water heated with the at least one cylinder and at least one valve to direct at least one of water from the tank into the cylinder and water from an external source into the cylinder.

The method comprises flowing a liquid into a heatable tube. The method further comprises illuminating a laser beam, produced by a laser, through an opening in a side wall of the heatable tube to illuminate an inner surface of the heatable tube to produce energy against at least where the laser beam terminates against an inner surface of the heatable tube. The method also comprises expanding an area where the energy is produced against the inner surface of the heatable tube by maintaining the laser beam for a desired time period to cause an area of energy to expand on the inner surface.

Another hot water heater system is disclosed comprising a plurality of heatable tubes, each having a respective outer wall with openings extending through the outer wall to an inner cavity, wherein water passes through the inner cavity. The hot water heater also comprises a plurality of lasers with each respective laser positioned proximate a respective opening to illuminate a laser beam into a heatable tube of the plurality of tubes that the respective laser is associated with, the laser beam terminating against an inner wall of the respective tube to heat the respective heatable tube. The hot water heater further comprises a water tank to hold water heated with at least one tube of the plurality of tubes, and at least a first valve to direct at least one of water from the tank into the respective heatable tube and water from an external source into the respective heatable tube. The hot water heater further comprises at least a second valve to at least one of maintain water in at least the respective tube and to pass the water to the tank, and a pumping device to cause water to flow from the tank to at least one heatable tubes of the plurality of tubes.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
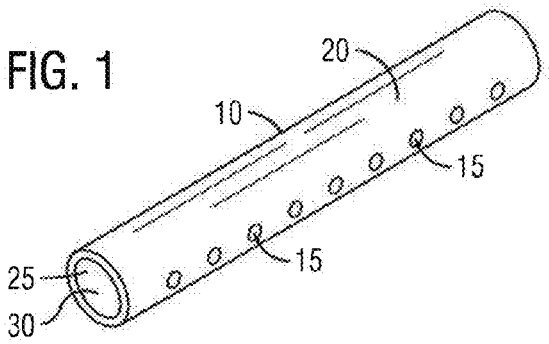
FIG. 1 shows a block diagram of an embodiment of a laser heat tube.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

FIG. 1 shows a block diagram of an embodiment of a laser heat, or heatable, tube. The tube is made of a heatable material, such as a metal. A non-limiting example of the heatable material is brass. As shown, the tube 10 has a plurality of openings 15, or holes, placed along an outer surface 20 of the tube 10 which reach into the inner cavity 25 of the tube 10. The holes 15 are provided to allow for a laser beam 610, shown in FIG. 6, to be illuminated within the tube 10 so that the laser beam 610 may terminate against an inner surface 30 of the tube 10. The laser beam 610 produces energy against the inner surface 30 of the tube 10 to cause the tube 10 to become heated, starting at the inner surface 30 and expanding through wall surface of the tube 10 eventually reaching the outer surface 20.

Figure 6:
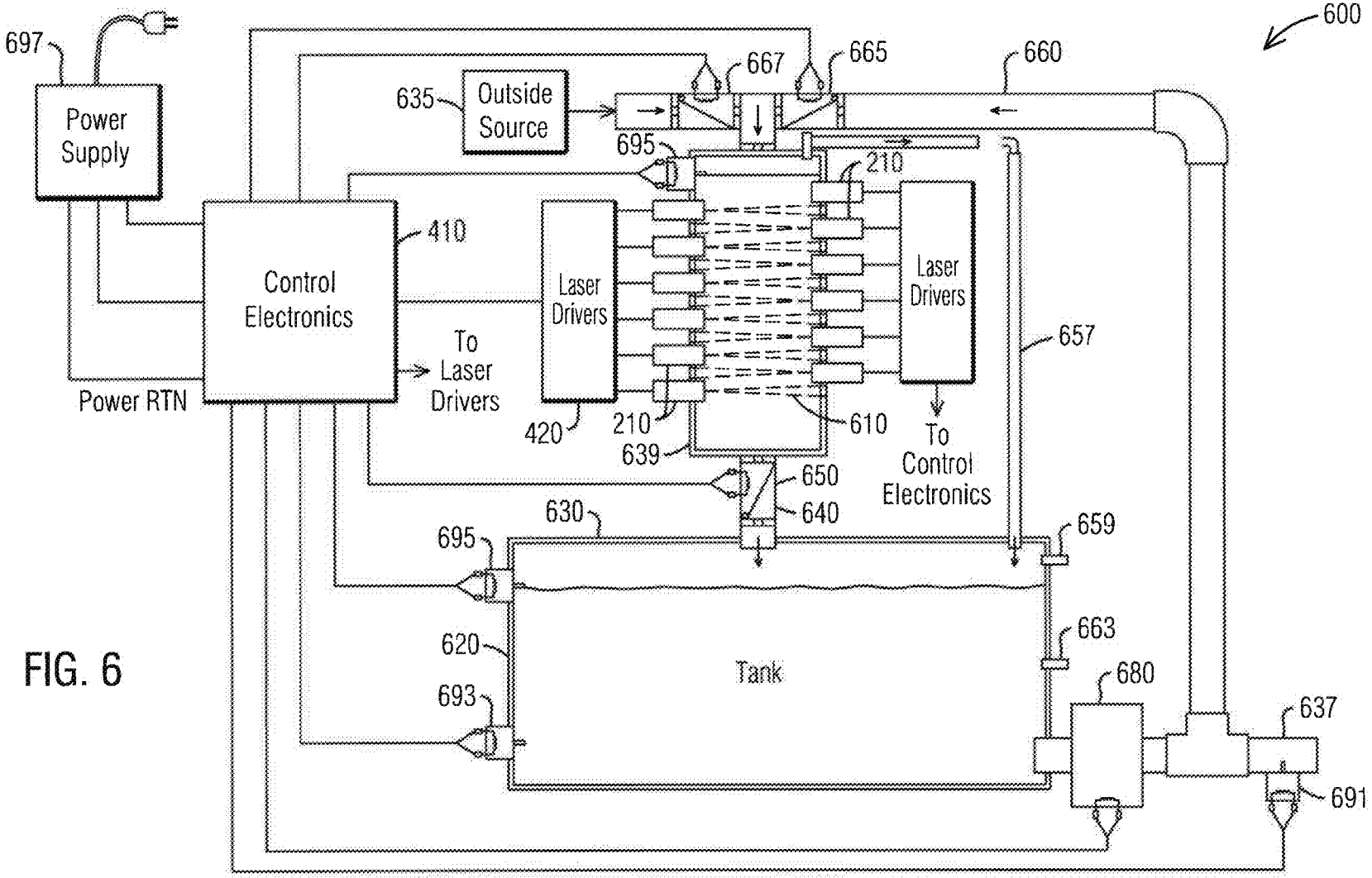
FIG. 6 shows a block diagram of a system utilizing the heat tube.

A liquid 620 (as shown in FIG. 6) such as, but not limited to, water, is passed through the tube 10. Therefore, as used herein, the use of the term "water" is not meant to be a limiting term as the intent is for water to simply represent a type of liquid whereas other types of liquid may also be used. Thus, by heating the tube 10, the water 620 within the tube 10 is heated. Though the water 620 is primarily heated by the heating of the tube 10, loss of heat, or energy from the laser beam 610 as it passes through, the water 620 also provides a lower level of heating of the water 620. However, though the laser beam 610 passes through the water 620, the laser beam 610 is actually indirectly heating the water 620 as primary heating of the water is caused by the tube 10.

Figure 2A:
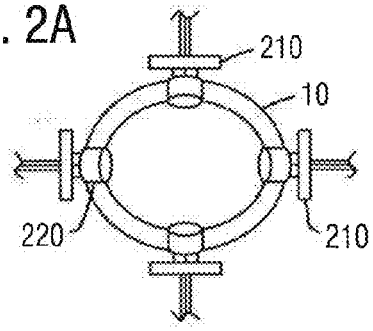
FIG. 2A shows a top view of the laser heat cylinder.

FIG. 2A shows a top view of the laser heatable, or heat, tube. As shown, the tube 10 has a plurality of lasers 210 that are in direct contact with the tube 10. Though the tube 10 is cylindrical, the tube 10 may comprise a plurality of elongated shapes, including cylindrical, circular, oval, rectangular, square, diamond, etc., when looking at the tube 10 from a top view, top end or bottom end. Therefore, the term "tube" is not used herein to be limiting to a particular shape. Similarly, the use of another term representing the tube such as, but not limited to, "cylinder" also is not used herein to be limiting as to a particular shape. However, it should be noted that since no corners are formed, a cylindrical, circular, or oval configuration may work best since the heat may be more evenly distributed over the inner and outer surface area of the tube.

As a non-limiting example, when the cylindrical tube is used, the tube may have a diameter of approximately 2 inches (approximately 5.08 centimeters) and a length of approximately 9.5 inches (approximately 24.13 centimeters). These dimensions are not provided to be limiting as the dimensions may vary to be larger or smaller, depending on the intended use of an embodiment disclosed herein.

Figure 2B:
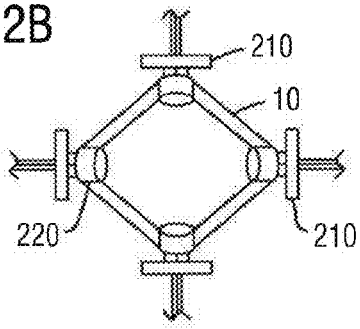
FIG. 2B shows a top view of the laser heat tube as a square.

In another embodiment, shown in FIG. 2B, where the tube 10 has corners, such as when square, rectangular or diamond, the lasers 210 may be placed at the corners so that the laser beams 610 contact the inner surface 30 close to the inner corner and expands along the flat surface of the inner corner.

In an embodiment, the lasers 210 may be located, attached, or secured to provide for a surface of at least one laser 210 making direct contact, at 220, to the tube 10 such as, but not limited to, being fitted within at least one opening 15 of the tube 10. In this configuration, in addition to producing energy against the inner surface 30 of the tube 10 to produce heat, the contact area 220 of the tube 10 and the laser 210 also produces heat. In another embodiment, the lasers 210 do not make direct contact with the tube 10 and instead just the laser beam 610 passes through the opening 15 and terminates against the inner surface 30 of the tube 10. In this embodiment, energy may be produced at the opening 15, depending on a width of the beam path of the laser beam 610 at the opening 15.

Figure 3:
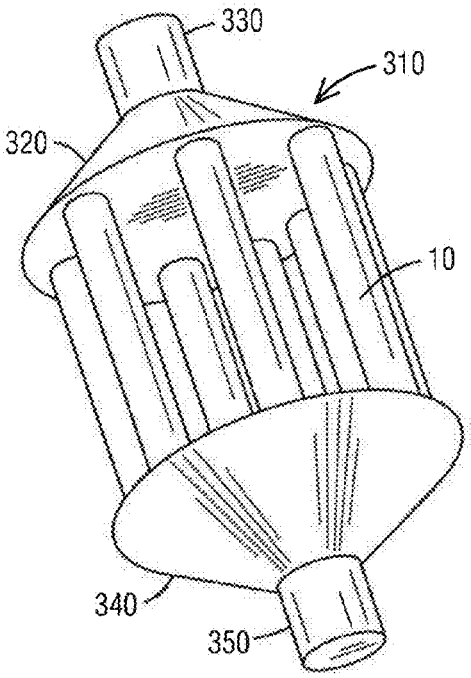
FIG. 3 shows a perspective view of a plurality of laser heat tubes within a module.

FIG. 3 shows a perspective view of a plurality of laser heatable, or heat, tubes within a module. Though not limiting, as shown, eight heatable tubes 10 are provided within the module 310. The module 310 has top, or upper, half 320 to which a singular entry path 330, or entry line, is provided and lower or bottom half 340 to which a singular exit path 350, or exit line, is provided. The entry path 330 is provided for the liquid 620 to reach at least one of the plurality of tubes 10. A directing device such as, but not limited to, a valve, may be within the upper half 320 of the module 310 to direct liquid 620 to a particular tube 10 or tubes 10. Thus, the module 310 may be configured with redundancy should any lasers 210 fail to operate on any particular tube 10.

Figure 4:
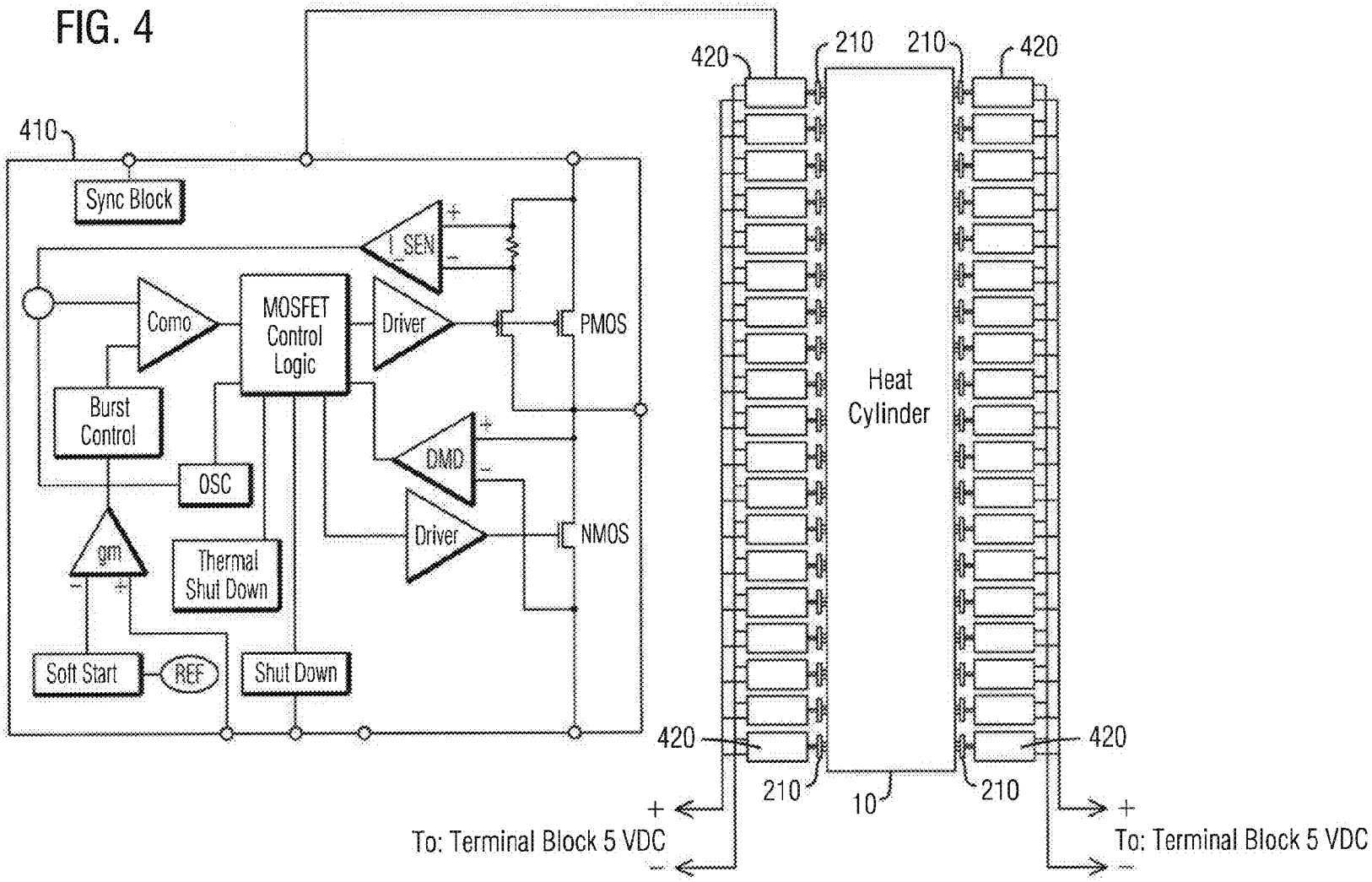
FIG. 4 shows a side view of the laser heat tube with a plurality of lasers attached.

FIG. 4 shows a side view of the laser heat cylinder with a plurality of lasers attached. A controller 410 is provided. The controller 410 may be used to control the lasers 210. When a plurality of tubes 10 is used, as illustrated in FIG. 3, the controller 410 may detect if or when any lasers 210 are not functioning. The controller 410 may then determine and direct which tubes 10 are utilized when heating of the liquid 620 is desired. The controller 410 may determine or detect a failed laser 210 by receiving information regarding a voltage using by a particular tube 10 during operation or by monitoring liquid temperature and a length of time it takes to heat the liquid within the tube 10. Thus, in an embodiment additional tubes 10 may be provided within a system so that as tubes 10 fail, the additional tubes 10 may be brought on line and used. Using this approach can increase a life of a system utilizing an embodiment disclosed herein.

As further illustrated, each laser 210 may have a driver 420 associated with the laser 210 or a group of lasers 210. A non-limiting example of the laser 210 may be a laser diode. The laser diode is an electrically pumped semiconductor laser in which an active laser medium is formed by a p-n junction of the semiconductor diode. Such lasers 210 may operate at an ultra violet frequency which may result in the lasers 210 also sterilizing the liquid 620 as it passes through the tube 10 during the heating of the liquid 620. As a non-limiting example, bacteria may be found in the liquid 620, such as, but not limited to, water. Because of the wavelength of the laser beam 610, as disclosed herein, the bacteria may be removed from the water by the laser beam 610. In an embodiment, a blue laser diode, which is a solid state laser, may be used. The laser 210 may operate at a low wattage such as, but not limited to, approximately 4.7 Watts, wherein "approximately" includes plus or minus 1 Watt. Thus, a wavelength of the laser 210 may be approximately 300-800 nanometers. Laser diodes may be directly modulated with modest power requirements as explained herein.

Figure 5:
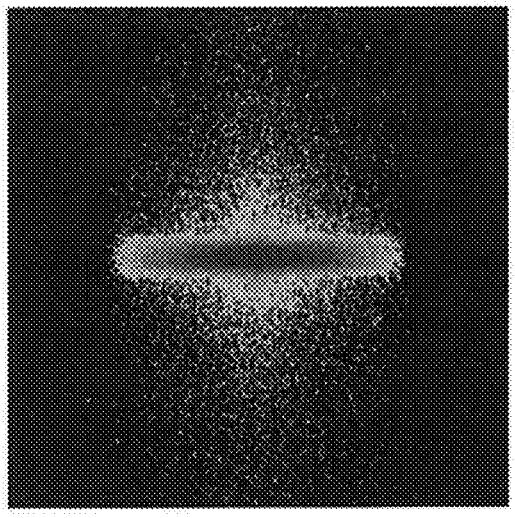
FIG. 5 shows a simulated spot size within a laser heat cylinder.

FIG. 5 shows a simulated spot size within the laser heat cylinder. With respect to this simulation, the material used for the tube 10 is brass. As shown an output directly from the diode may be asymmetric. The beam divergence is different in the plane parallel and perpendicular to the emitting junction.

FIG. 6 shows a block diagram of a system utilizing the heatable tube. For illustration purposes only a single tube 10 is shown. As shown, the system 600 has a plurality of lasers 210 attached to the tube 10. The lasers 210 are located so that the laser beam 610 produced by each laser 210 terminates against the inner surface 30 of the tube 10 where an opening in the tube is not included. The laser drivers 420 are provided to operate the lasers 210. The laser drivers 420 and hence the lasers 210 are controlled by the controller 410. A tank 630 is provided. The tank 630 may be a non-pressurized tank. As a non-limiting example, the tank 630 may be a polyurethane tank. An exit feed line 640 is provided to transport the liquid 610 from the tube 10 to the tank 630. A release valve 650 is provided at the exit feed line 640. The valve 650 is controlled by the controller 410 and is opened or closed depending on whether an intent is for the liquid 610 to remain stationary in the tube 10 during heating of the liquid 620 or for the liquid 620 to be continuously flowing through the tube 10 during heating.

An entry feed line 660 is also included to feed liquid 620 into the tube 10. Though two entry valves 665, 667 are shown, at least one entry valve may be provided to supply liquid 620 either from the tank 630 or an outside source 635 to the tube 10. A hot liquid delivery line 637 is also provided to deliver the heated liquid, stored within the tank 630, to an external location for use as heated liquid. A pump 680 is included. The pump 680 may be used to pump the liquid through the entry feed line 660 to the tube 10 or through the hot liquid delivery line 637 for an intended use external the system. The pump 680 is controlled by the controller 410 to operate when a need for hot liquid is detected.

A plurality of sensors may also be included, which are controlled by the controller. As a non-limiting example, a flow sensor 691 may be provided to regulate a flow of heated liquid through the hot liquid delivery line 637. At least one temperature sensor 693 may be provided to determine temperature within the tank 630. Though not shown, another temperature sensor may be included to determine temperature within the tube 10. At least one water, or liquid, level sensor 695 may be provided to at least one of measure liquid level within the tank 630 and/or within the tube 10.

The controller 410 is powered by a power supply 697. The power supply 697 may be a low wattage source such as, but not limited to, approximately 150 Watts to 300 Watts, plus or minus 50 Watts. The power supply 697 may be provided power from a plurality of sources, including, but not limited to, an electrical outlet, battery source, solar source, etc.

Also disclosed in an automatic air vent valve 657 connected between the heatable tube 10 and the tank 630, a pressure relief valve 659 that is connected to the tank 630, and a drain valve 663 also connected to the tank 630.

Though not expressly illustrated, in another embodiment, the tube 10 may be at least partially submerged or immersed within the liquid in the tank 630. In this configuration, in addition to heating the liquid within the tube 10, liquid within an outside area around the outer surface 20 of the tube 10 may also be heated once the outer surface 20 of the tube 10 is heated. Turning back to FIG. 6, in this embodiment, the lower end or lower part of the tube 639 where the exit valve 650 is located may be within the tank 630. Therefore, the illustration of FIG. 6 is shown to illustrate the components disclosed herein, but not necessarily their placement with respect to each other.

The system may operate in one of at least three modes. In a first mode, the liquid 620 is feed into the tube 10 from an external liquid source 635. The liquid 620 is held within the tube 10 and heated. Once heated, the liquid 620 is deposited into the tank 630, by opening the exit valve 650. In a second mode, the liquid 620 is feed into the tube 10 from the tank 630. The liquid 620 is held within the tube 10 and is heated. Once heated, the liquid 620 is returned to the tank 630. In a third mode, the liquid 620 is provided from either the external source 635 or the tank 630 and is continuously fed into the tube 10 and immediately into the tank 630. In this third mode, the liquid 620 is not being held in the tube 10. In this third mode, since the liquid 620 in the tank 630 is already somewhat heated, the third mode is primarily used with liquid from the tank 630 and not liquid 620 from the external source (as liquid from the external source likely will be cooler than the liquid in the tank). A combination of the modes disclosed herein may also be used.

When the system 600 is used as a hot water heater, temperatures of water would reach approximately 110 degrees Fahrenheit (F) in less than three hours when operating under the third mode described above and after about an additional two more hours the water reaches a temperature of approximately 140 degrees F.

In a non-limiting example, the tubes 10 are brass cylinder that is about 10 inches high and 4 inches in diameter. For a standard hot water heater used to heat a residence, at least two tubes described above may be used within the hot water heater. As suggested above, the lasers may be a low Wattage such as, but not limited to, approximately 5 Watts blue laser diodes that operate at a frequency between approximately 445 nm and 450 nm. The laser beam may have an optical beam power of approximately 1 Watts with a beam divergence of approximately 40.5 mrad. Power consumption of the system may be approximately 204 Watts. The power consumption is significantly less than the 4,500 Watts consumed by prior art water heaters. In addition to operating a lower wattage than the prior art hot water heaters, the embodiments disclosed herein also operate at an increased efficiency over prior art hot water heaters such as, but not limited to, resulting in a financial savings per year to heat water used by a residential dwelling when compared to prior art water heaters.

Figure 7:
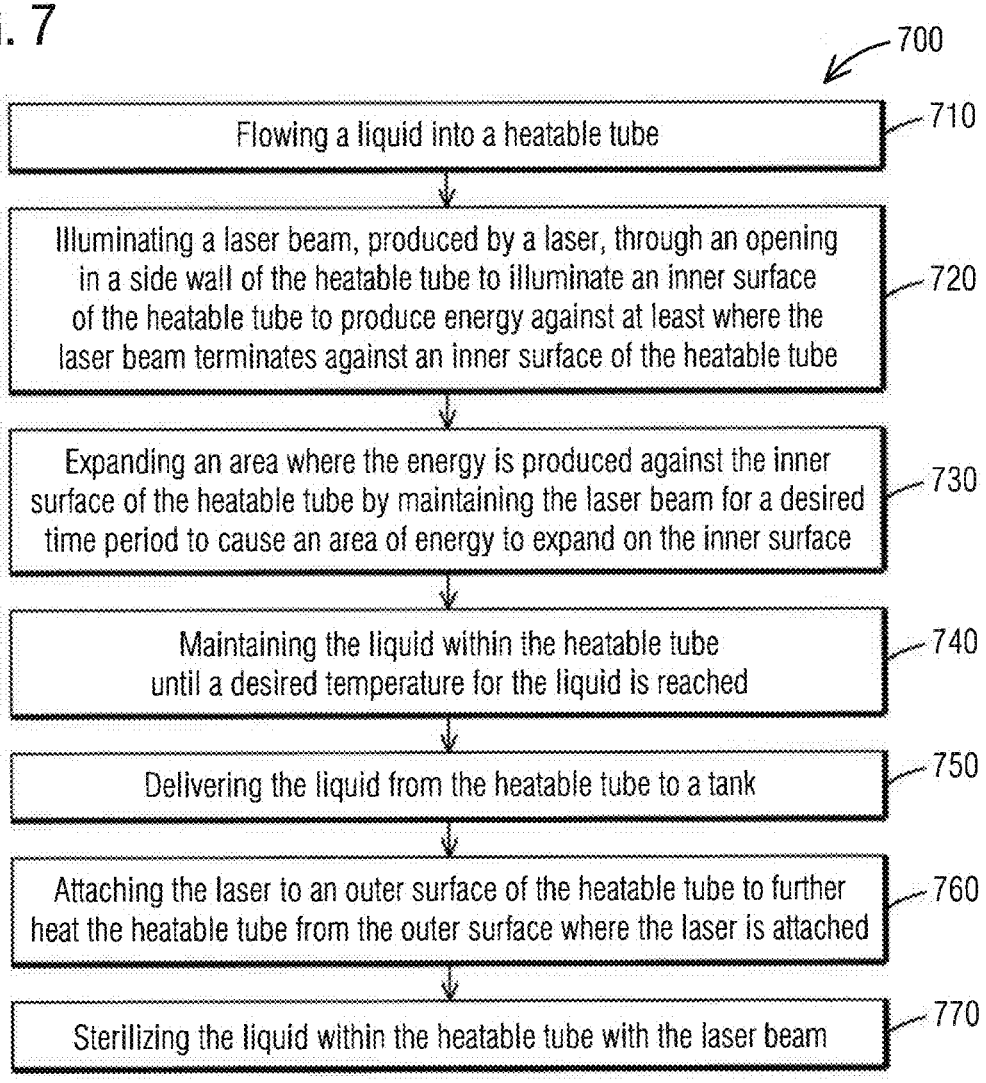
FIG. 7 shows a flowchart illustrating an embodiment of a method for indirectly heating water with a laser.

FIG. 7 shows a flowchart illustrating an embodiment of a method for indirectly heating water with a laser. The method 700 comprises flowing a liquid into a heatable tube, at 710. The method 700 further comprises illuminating a laser beam, produced by a laser, through an opening in a side wall of the heatable tube to illuminate an inner surface of the heatable tube to produce energy against at least where the laser beam terminates against an inner surface of the heatable tube, at 720. The method 700 further comprises expanding an area where the energy is produced against the inner surface of the heatable tube by maintaining the laser beam for a desired time period to cause an area of energy to expand on the inner surface, at 730.

The method 700 may further comprise maintaining the liquid within the heatable tube until a desired temperate for the liquid is reached, at 740. The method 700 may also comprise delivering the liquid from the heatable tube to a tank, at 750. The method may further comprise attaching the laser to an outer surface of the heatable tube to further heat the heatable tube from the outer surface where the laser is attached, at 760. The method 700 may also comprise sterilizing the liquid with the laser beam within the heatable tube, at 770. Though the method 700 is shown in a particular order, the steps shown may be placed in another order.

Though embodiments are shown with respect to a water heater, as suggested above, the embodiments may be used to heat other liquids. As a non-limiting example, embodiments may be used to heat a food product such as, but not limited to, soup, as it is mixed at a facility prior to canning. In another non-limiting embodiment, embodiments may be used under a surface such as, but not limited to, a sidewalk or floor to heat the surface. With respect to sidewalks, once snow has fallen, the sidewalks may be cleared of the slow by heating water that is run in tubes under the sidewalk utilizing an embodiment disclosed herein.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

I claim:

1. A system comprising:

a heatable tube, through which a liquid flows within the heatable tube, with at least one opening formed through an outer wall of the tube; and a laser directing a laser beam through the opening to an inner surface of the heatable tube to heat the heatable tube when the liquid is present within the heatable tube.

2. The system according to claim 1, wherein the laser comprises a surface that contacts an outer surface of the heatable tube to heat the heatable tube.

3. The system according to claim 1, further comprising a feed line to transport the liquid to the heatable tube and a tank to collect liquid that has passed through the heatable tube.

4. The system according to claim 3, wherein the system is a water heater.

5. The system according to claim 1, wherein the heatable tube comprises a metal which has at least one of a cylindrical, oval, rectangular, and square elongated shape when viewed from a top end of the heatable tube.

6. The system according to claim 1, wherein the laser produces approximately four watts.

7. The system according to claim 3, wherein the feed line comprises a valve to provide liquid from the tank to pass into the heatable tube and remain in the heatable tube while being heated.

8. The system according to claim 3, wherein the feed line comprises a valve to provide liquid from an outside source to pass into the heatable tube and remain in the heatable tube while being heated.

9. The system according to claim 3, further comprising a second valve to control when the liquid returns to the tank from the heatable tube.

10. The system according to claim 3, wherein at least a lower part of the heatable tube is immersed within the liquid of the tank wherein liquid within the heatable tube and around an outside area of the heatable tube is heated by laser heating the inner surface of the heatable tube.

11. The system according to claim 1, wherein the laser operates at a wavelength to sterilize the liquid while the liquid is being heated.

12. A hot water heater system comprising:

at least one cylinder with an outer wall with openings extending through the outer wall to an inner cavity, wherein water passes through the inner cavity;

a plurality of lasers with each respective laser positioned proximate a respective opening to illuminate a laser beam into the cavity and terminating against an inner wall of the cylinder to heat the cylinder;

a water tank to hold water heated with the at least one cylinder;

at least one valve to direct at least one of water from the tank into the cylinder and water from an external source into the cylinder.

13. The system according to claim 12, further comprising a second valve to at least one of to maintain water in the cylinder and to pass the water to the tank.

14. The system according to claim 12, further comprising a water level sensor to determine at least one of water level within the at least one cylinder and water level within the tank.

15. The system according to claim 12, wherein at least a lower part of the at least one cylinder is immersed within the water of the tank and wherein the water within the at least one cylinder and around an outside of the at least one cylinder is heated by the plurality of lasers heating the at least one cylinder.

16. The system according to claim 12, wherein the at least one cylinder comprises brass.

17. The system according to claim 12, wherein at least one laser of the plurality of lasers comprises a surface that contacts an outer surface of the at least one cylinder to heat the at least one cylinder.

18. A method comprising:

flowing a liquid into a heatable tube;

illuminating a laser beam, produced by a laser, through an opening in a side wall of the heatable tube to illuminate an inner surface of the heatable tube to produce energy against at least where the laser beam terminates against an inner surface of the heatable tube; and expanding an area where the energy is produced against the inner surface of the heatable tube by maintaining the laser beam for a desired time period to cause an area of energy to expand on the inner surface.

19. The method according to claim 18, further comprising maintaining the liquid within the heatable tube until a desired temperate for the liquid is reached.

20. The method according to claim 18, further comprising delivering the liquid from the heatable tube to a tank.

21. The method according to claim 18, further comprising attaching the laser to an outer surface of the heatable tube to further heat the heatable tube from the outer surface where the laser is attached.

22. The method according to claim 18, further comprising sterilizing the liquid within the heatable tube with the laser beam.

23. A hot water heater system comprising:

a plurality of heatable tubes, each having a respective outer wall with openings extending through the outer wall to an inner cavity, wherein water passes through the inner cavity;

a plurality of lasers with each respective laser positioned proximate a respective opening to illuminate a laser beam into a respective heatable tube of the plurality of heatable tubes that the respective laser is associated with, the laser beam terminating against an inner wall of the respective tube to heat the respective heatable tube;

a water tank to hold water heated within at least one respective heatable tube of the plurality of heatable tubes;

at least a first valve to direct at least one of water from the tank into the at least one respective heatable tube and water from an external source into the at least one respective heatable tube;

at least a second valve to at least one of maintain water in at least the one respective heatable tube, and to pass the water to the tank; and a pumping device to cause water to flow from the tank to at least one respective heatable tube of the plurality of heatable tubes.

24. The system according to claim 23, further comprising at least one water level sensor to determine at least one of a water level within the at least one heatable tube, at least one temperature sensor, and at least one flow sensor.

25. The system according to claim 23, wherein at least one laser of the plurality of lasers comprises a surface that contacts an outer surface of the at least one heatable tube that the at least one laser is associated with to heat the at least one heatable tube at the contact between the at least one laser and the at least one heatable tube.

26. The system according to 24, further comprising a controller to operate at least one of the plurality of lasers, the at least one water level sensor, the at least one temperature sensor, and the at least one flow sensor.

27. The system according to claim 26, further comprising a low wattage power supply to power the controller.

28. The system according to claim 23, wherein the plurality of heatable tubes are a part of a module with a water entry line and a water exit line and at least one valve to direct water flow through at least one heatable tube of the plurality of heatable tubes.

29. The system according to claim 26, wherein the plurality of heatable tubes are a part of a module with a water entry line and a water exit line and at least one valve to direct water flow through at least one heatable tube of the plurality of heatable tubes and wherein the controller controls the at least one valve to determine which at least one heatable tube of the heatable tubes the water flows into.

* * * * *